US008572915B2

(12) United States Patent
Meahl

(10) Patent No.: US 8,572,915 B2
(45) Date of Patent: Nov. 5, 2013

(54) COVE BASE CORNER COVER

(76) Inventor: Gregory L. Meahl, Sierra Madre, CA (US)

( * ) Notice: Subject to any disclaimer, the term of this patent is extended or adjusted under 35 U.S.C. 154(b) by 383 days.

(21) Appl. No.: 12/977,062

(22) Filed: Dec. 23, 2010

(65) Prior Publication Data

US 2011/0094174 A1 Apr. 28, 2011

Related U.S. Application Data

(63) Continuation-in-part of application No. 11/983,122, filed on Nov. 7, 2007, now Pat. No. 7,866,102.

(51) Int. Cl.
*E04B 2/00* (2006.01)

(52) U.S. Cl.
USPC ..... 52/288.1; 52/287.1

(58) Field of Classification Search
USPC ..... 52/265, 631, 287.1, 288.1
See application file for complete search history.

(56) References Cited

U.S. PATENT DOCUMENTS

| | | | | |
|---|---|---|---|---|
| 2,069,289 | A | 2/1937 | Swendsen et al. | |
| 2,307,338 | A | 1/1943 | Shiyter et al. | |
| 2,915,794 | A | 12/1959 | Hillmann | |
| 3,707,061 | A | 12/1972 | Collette | |
| 3,782,235 | A | 1/1974 | Curcio | |
| 3,942,295 | A | 3/1976 | Schacht | |
| 4,095,500 | A | 6/1978 | Rouse | |
| 4,150,517 | A | 4/1979 | Warner | |
| 4,161,853 | A | 7/1979 | Weiss et al. | |
| 4,315,390 | A | 2/1982 | Schaafsma | |
| 4,436,014 | A | 3/1984 | O'Neill | |
| 4,852,318 | A | 8/1989 | Anderson | |
| 5,010,703 | A | 4/1991 | Pearlman et al. | |
| 5,179,811 | A | 1/1993 | Walker et al. | |
| 5,199,237 | A | 4/1993 | Juntunen | |
| 5,522,296 | A | 6/1996 | Stoller | |
| 5,549,862 | A | 8/1996 | Vail | |
| 5,756,933 | A | 5/1998 | Pitchford et al. | |
| 5,802,790 | A | 9/1998 | Lamont et al. | |
| 5,893,246 | A | 4/1999 | Smythe, Jr. | |
| 5,904,017 | A | 5/1999 | Glatz et al. | |
| 6,073,406 | A | 6/2000 | Kearney | |
| 6,216,407 | B1 | 4/2001 | LeBlanc | |
| 6,237,459 | B1 | 5/2001 | Brown | |
| 6,419,207 | B1 | 7/2002 | Barry et al. | |
| D486,920 | S | 2/2004 | Hein et al. | |
| 6,969,053 | B2 | 11/2005 | Kawada et al. | |
| D549,844 | S | 8/2007 | Beard, Jr. | |
| D581,060 | S | 11/2008 | Beard, Jr. | |
| 7,591,118 | B2 * | 9/2009 | Shaw et al. | 52/718.04 |
| 2003/0014931 | A1 | 1/2003 | Hahn | |

* cited by examiner

*Primary Examiner* — William Gilbert
*Assistant Examiner* — Alp Akbasli
(74) *Attorney, Agent, or Firm* — George P. White

(57) ABSTRACT

An apparatus is used to cover a wall corner where lengths of cove base meet. One part is a wall adapter. It is composed of a right angle of thin material with one-half of a mechanical mating structure at its outer apex. The other part is a corner cover composed of a right angle of a thicker material with a narrower extent, but taller than the wall adapter. The cove base corner cover provides a unified junction between the two adjacent cove base sides of a corner. The corner cover is initially held correctly in place by being mechanically mated to the wall adapter. Corners may be inside or outside corners. Matings include snap fit, friction fit and a hanging tab and slot. These two types of covers might operate with a common wall adapter, but, of course, are of somewhat complementary shapes. Their right angles face in opposite orientations.

11 Claims, 6 Drawing Sheets

COVE BASE CORNER COVER

RELATED APPLICATIONS

This application claims priority from and incorporates by reference in its entirety application Ser. No. 11/983,122 filed Nov. 7, 2007 and published as US2009/0113840 A1 on May 9, 2009. The present application is a Continuation-in-Part of that cited application.

FIELD

This invention relates to fixed construction particularly to pre-made corner covers to provide a clean finish for the installation and repairs of cove base at corners formed by intersecting walls.

BACKGROUND

The construction industry introduced cove base to provide an easily cleanable "baseboard" of a synthetic material that left no gap between a vinyl floor and a wall. It is generally made of vinyl, is provided in long, generally flat strips that have a curved feature along one of the long edges. When installed, the curved area provides a continuous transition from floor to wall. Cove base is convenient to install along a wall but in corners, it can be difficult to produce a clean, finished appearance. Installing cove base at intersecting corners can be very difficult and time-consuming. While outside corners are more troublesome, inside corners also present difficulties.

A common method for installing cove base at an outside corner is to wrap a continuous length of cove base around the corner. This process can be very frustrating and time-consuming taking many steps to accomplish the task. One of the steps in the procedure is reducing the material in the back by carving or gouging to reduce the thickness at the region of the cove base making the 90-degree turn around the corner. Nonetheless wrapping most often results with an undesirable appearance, with the bottom cove portion collapsing into itself. In addition, the tension produced often stresses the bottom contour to the point of eventually splitting, thereby creating a gap in an open upside down V shape. If too much material is taken out of the back, a hole is created on the front side forcing the installer to start over with a new piece. Although reducing material from the back is imperative in this method, it contributes to reduced integrity of the cove base at the corner's vertex.

Inside corners can be less troublesome. Nevertheless, they present other problems particularly when the wall is out of plumb. When bending a length of cove base to fit in an inside corner generally a slice of a small depth is made on the backside at the vertex and the bottom of the cove base is cut out at about a 45-degree angle creating an upside down V notch. If not done precisely and in the position that will fall at the exact corner, this can result in a ruined length of material and a need to repeat the procedure. Between the extra labor incurred and possible other complications associated with facilitating installations at intersecting corners, a better method has been sought.

Several approaches have been used and proposed to address some of these problems including a contribution of the present inventor U.S. patent application Ser. No. 11/983,122 published as US 2009/0113840 A1 on May 7, 2009. That reference discloses a unitary corner cover that is adhered over the rough-cut ends of the two respective lengths of cove base.

Remaining problems include color matching to the wide variety of cove base material and holding a corner cover accurately in place while the adhesive sets up.

SUMMARY

These teachings include a corner cover that goes over the rough-cut ends of two separate lengths of cove base that are each cut near a corner they both approach. An embodiment comprises an integrally formed cover for an external corner with an elongated midsection defining a pair of generally flat perpendicular faces. The faces intersect to form a front facing vertex and have rear surfaces. The rear surfaces are spaced away from a wall that the cover is abutted against. This consequence is due to the shape of the upper and lower extremities of the cover that provide the points of contact respectively between the wall and the cover and the floor and the cover. In this outer corner teaching, the 90-degree angle of the intersecting flat faces is oriented inward to the corner, of course. The space or gap between the cover and the wall accommodates the thickness of cove base. An inward curvature at the top of the corner cover hides the area where the two cove base lengths do not meet at the vertex of the corner. The outward curve of the lower portion provides for the gap to be curved and thereby provide room for the lower, cove shaped portion of the cove base to be behind the corner cover without a significant visible gap.

Other aspects of the teachings include corner covers for inside corners. In this case, the concave right angle of the two generally flat midsection areas faces outward. The upper portion is curved back towards the wall in an amount effective for causing a cove base shaped gap between the wall and the corner cover when the corner cover is generally parallel to, and abutted to, the wall.

These teachings also encompass a second, complementary mounting piece. It can be a wall adapter comprising a right-angled item of two thin flat surfaces with a mating structure at its exterior apex. In this teaching the corresponding corner cover can have a complementary mating structure on its inside apex.

A method of use can be to first adhere the wall adapter to the wall's corner. The cove base can be positioned and adhered on the left and the right of the corner, covering at least a portion of the wings of the wall adapter. A complementary corner cover can then be mechanically mated with the wall adapter. A variety of mating structures can be used.

In devices in accord with this aspect of the teachings, the corner cover may be hooked, snapped, friction fit, or otherwise held mechanically in place by the mating of the complementary structures at the external apex of the wall adapter and the internal apex of the corner cover. In some cases, this may provide the entire support for the corner cover. In others, it might only be retained sufficiently to hold the corner cover in place while an adhesive sets.

DETAILED DESCRIPTION

Figure 1:
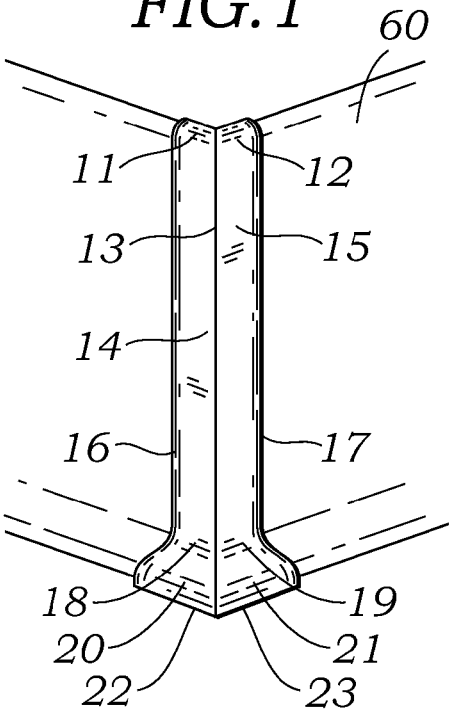
FIG. 1 shows a first embodiment of an outside cove base corner cover in use from a front view.
Figure 2:
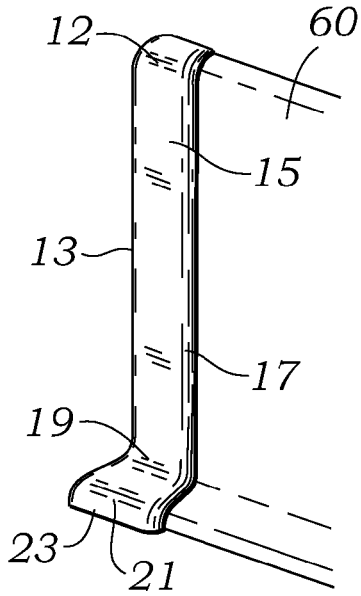
FIG. 2 shows the right side of the unit of FIG. 1 in use.
Figure 3:
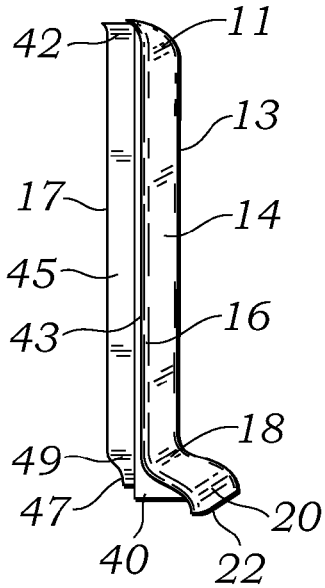
FIG. 3 shows a corner cover left side; in this view, the backside is partially visible.
Figure 4:
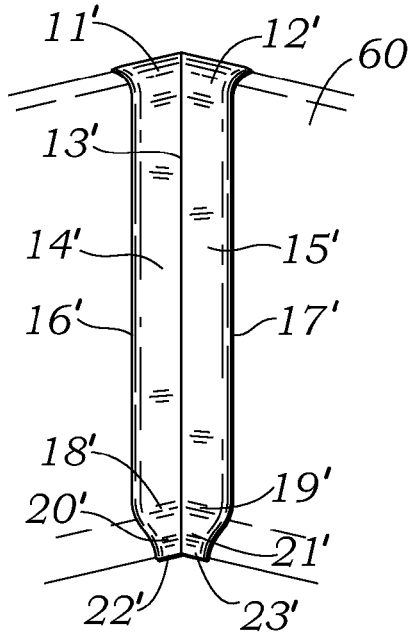
FIG. 4 shows a first embodiment of the inside cove base corner cover from a front view.

An embodiment of an outside corner cover of the present invention is illustrated in FIGS. 1, 2, and 3. FIG. 4 shows an inside corner cover version. These covers have an integrally formed elongated body comprised of thin walls. The thickness of these walls can preferably be between 0.10 and 0.125 inches along. However, the thickness can be varied from as thin as a piece of tin or sheet metal or as thick up to 0.5 inches, in various applications. A thicker unit, for example, can be for use as a very durable corner protector. Each side can be of sufficient horizontal width to overlap and cover cuts in the cove base made without exact precision The view of FIG. 1 is a front prospective view of an outside (external) cove base corner cover. The two front panels 14 15 are mutually perpendicular and symmetric in shape to each other. They are generally flat throughout their mid regions but having a contoured shape in the lower and upper portions. The lower portion flares out in a foot. In order to correspond to the outside wall corner being covered, the front panels have their convex side facing outwards. At the upper portion, the contour 11 12 curves backward toward the wall and over the cover base cut ends. The front vertical corner, the vertex 13, may be rounded or squared. The left side panel 14 and the right side panel 15 midsection faces are flat and tapered off round at their respective outside edges 16 17. The foot at the lower portion of the cover is formed by concave curves 18 19 and then extends outwards and forwardly down in a contoured curved cove shape 20 21 with a final curve downwards to form a lip 22 23 to the bottom.

FIG. 2 shows the right side of this first embodiment in perspective view of the outside cove base corner cover. The top portion 12 extends back towards the wall, in this view to the right. This shape creates a gap between the cover and the wall to which it is abutted that is of a size and profile to accommodate cove base being covered.

The right side panel face 15 is flat and tapered round at its edge 17 in order to conform and blend in aesthetically as it engages with the cove base it overlaps. The lower portion has a curve 19 extending outwardly to the left and down in a contoured shape 21 23 corresponding to that of the cove base 60 it covers. FIG. 3 is a left perspective view of an outside corner cover consistent with the version shown in FIG. 1 and in FIG. 2. It has a glimpse of both a vertical 43 and an underside cove element support material 40 showing. In addition, a glimpse of the backside 45 of the right panel 15 in the version of FIG. 3, the rear side of the cover is seen to have a shape generally complementary to that of the front side.

In FIG. 4 a version of a cover for an inside corner is shown. In many ways, it is a symmetric complementary shape to that of the outside corner seen in FIGS. 1-3. This embodiment is intended to cover the rough-cut ends of cove base at an inside wall corner. It is comprised of two mutually perpendicular flat panels 14' 15'. However, they have their concave side facing outward. The left and right upper portions 11' 12' of the panels curve backward, over the cove base, towards the wall. The lower portions curve outward to make a small foot 18' 19' 20' 21' with a terminating lip 22' 23'.

The versions seen in FIGS. 1-4 can be secured in place in a variety of manners. They may be adhered or bonded to the cove base they cover. Alternatively, the rear surfaces of the flat panel areas might have a self-adhering, peel-off feature. Of these views, the rear side is only shown in FIG. 3. Alternate structures for securing a cove base cover embodiment to a wall corner by having an interlocking structure on the rear of the corner cover, are seen in figures presented and described below.

Wall Adapter Versions

Three-Tooth Version

Figure 5:
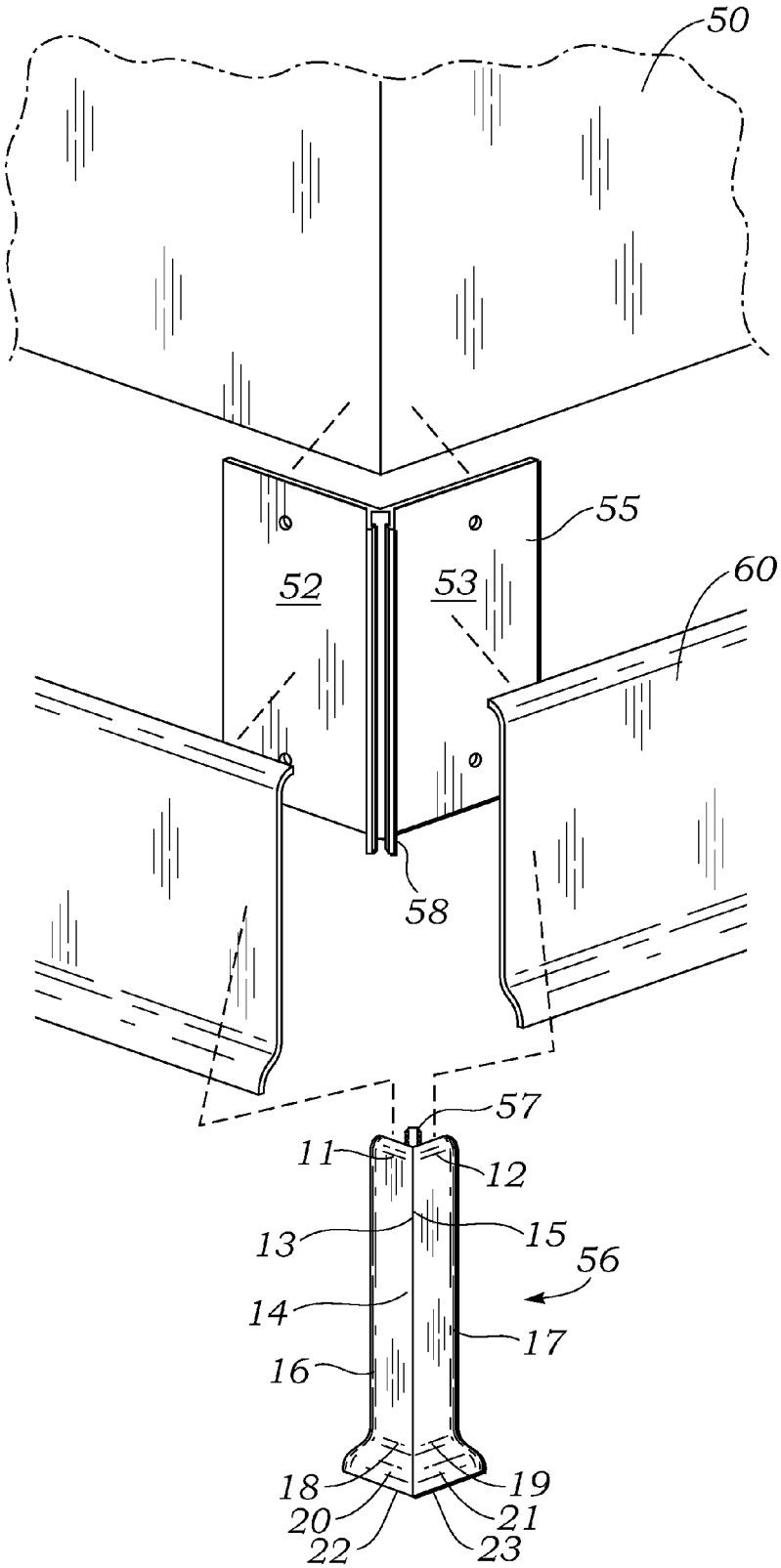
FIG. 5 is an exploded view of a corner cover system in use and including a wall adapter of a toothed version.

In some embodiments, a corner cover can be a two-piece unit. In FIG. 5, an exploded view is provided of a version that includes a cover 56 and a wall adapter 55. This system is for an outside corner of two walls 50. The wall adapter has two symmetrically disposed thin panels 52 53 at right angles and is intended to be secured to the wall corner. This can be done by adhesive bonding, by nail, or by other fasteners. At the external apex of the wall adapter is a female mating structure 58. After the wall adapter is secured to the wall corner, the two lengths of cove base are secured to the wall and wall adapter. This is likely done with an adhesive and leaves the female mating structure exposed. A specific embodiment of a corner cover 56 consistent with what is visible in FIG. 1 and FIG. 2 is seen to have a complementary male mating structure on its rear side. As seen in other views in FIGS. 6-9, the complementary mating structures include a one-way tooth configuration with three sets of mating teeth. In this version, the cover can be mechanically retained by the wall adapter in three distinct positions or depths. One application of this scheme is to provide for a gap-free, covering of cove base of varying thicknesses.

With a wall adapter having a complementary mechanical mating structure, embodiments can be such as to not require any adhesive or other bonding. In alternate versions, the mechanical retention might serve a purpose of holding the device in place while a bonding sets up.

Figure 6:
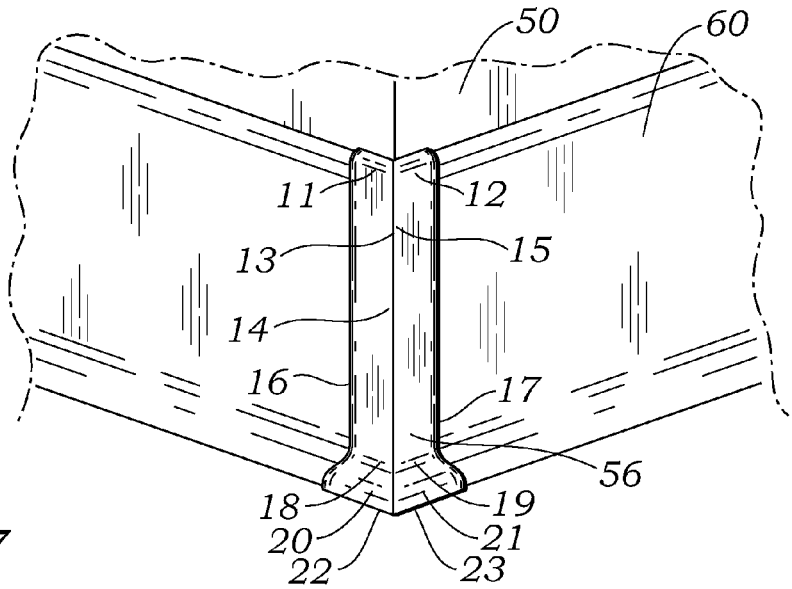
FIG. 6 is an unexploded version of the system of FIG. 5.
Figure 7:
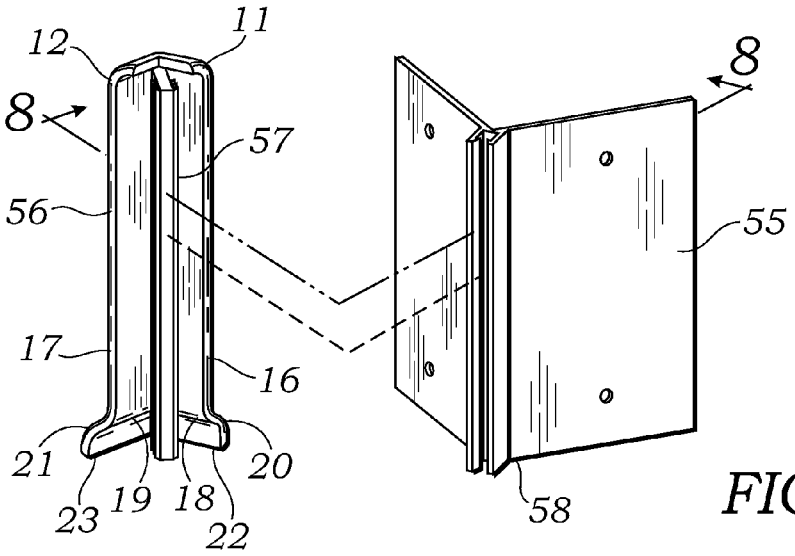
FIG. 7 shows the apparatus of FIG. 5 in perspective showing the rear of the cover and the front of the wall adapter.
Figure 8:
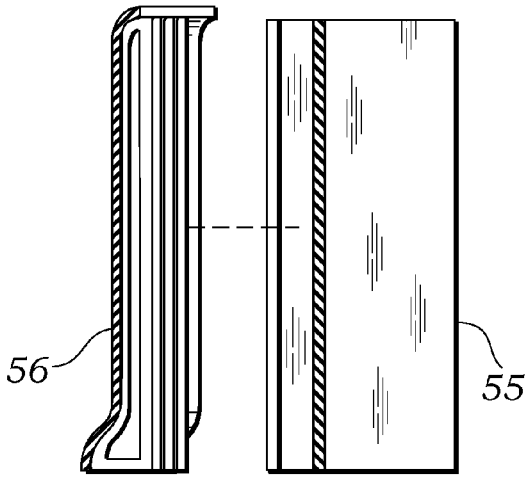
FIG. 8 shows a cut away view of the apparatus of FIG. 7 taken along the line 8-8.
Figure 9:
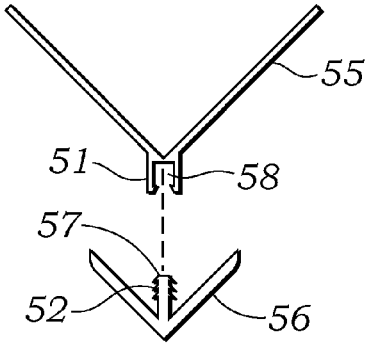
FIG. 9 shows a plan, schematic view of the toothed apparatus of FIG. 7 illustrating the mating mechanism.

FIG. 6 shows the system of FIG. 5 in an assembled state while FIG. 7 shows the rear of the cover including the tab 57 intended to interlock with the slot 58. In FIG. 8, a cut-away view is presented of this version from the left side. FIG. 9 is a plan, section, and schematic view allowing the toothed mating mechanism to be more clearly understood. The cover 56 has three sets of one-way teeth 52 on either side of its tab 57. In a complementary fashion, the wall adapter 55 has teeth 51 on the inside of its slot 58.

Figure 10:
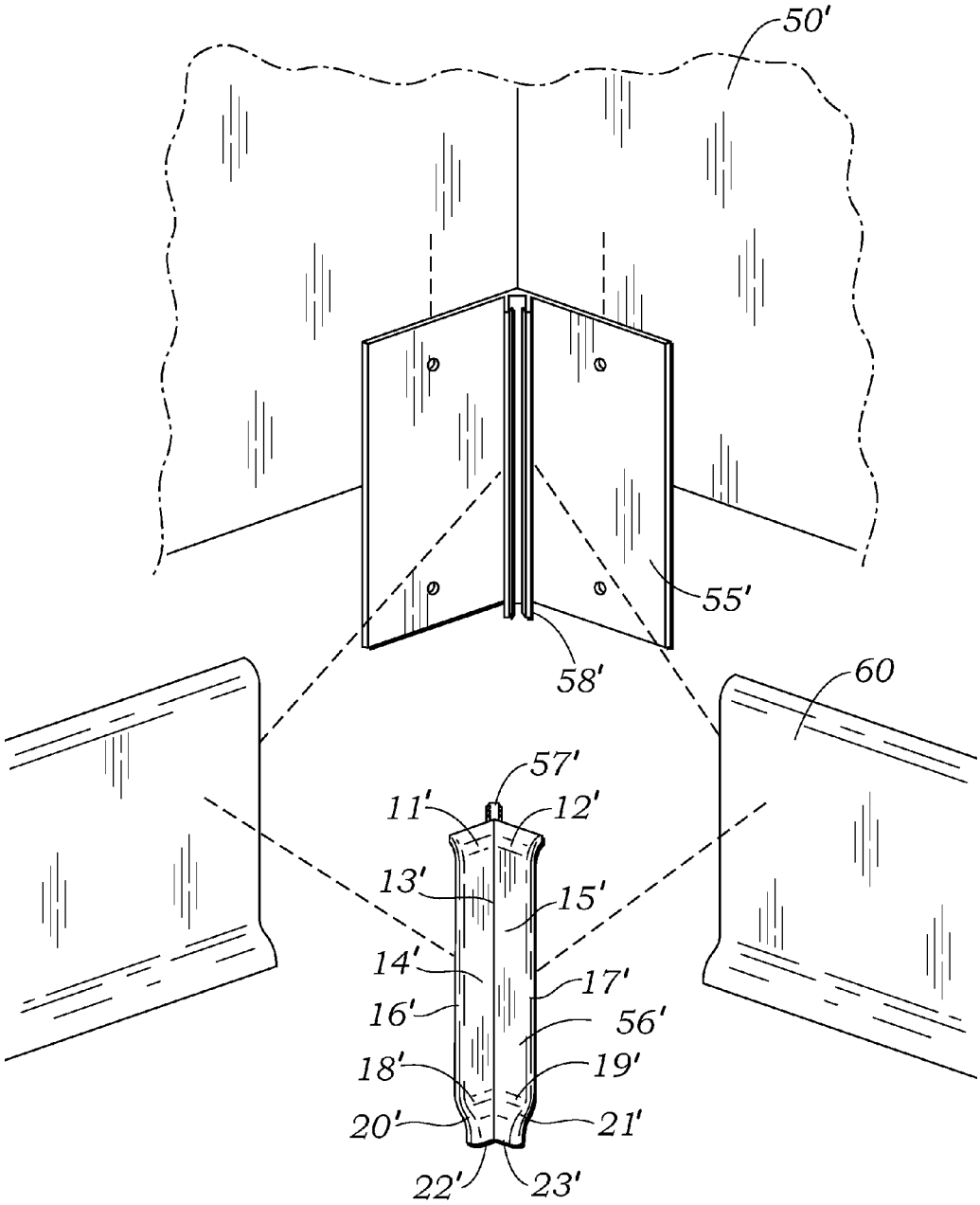
FIG. 10 is an exploded version of a system for covering an inside corner.

FIG. 10 shows an embodiment with a three-tooth retention structure in an inside corner version. In this case the wall 50' meets in an inside corner and the adapter 55' is of the shape of an inside corner with its mating structure 58' at a concave apex. As in the outside corner version previously presented, the two cove base 60 lengths are secured to the wall and wall adapter. Last, the inside corner cover 56' with an external shape consistent with that shown and described in FIG. 4, is secured to the wall adapter. In this version that is done via the toothed tab 57' at the rear of the cover mating with the complementary slot 58' structure of the wall adapter.

Rod and Hollow Cylinder Version

Figure 11:
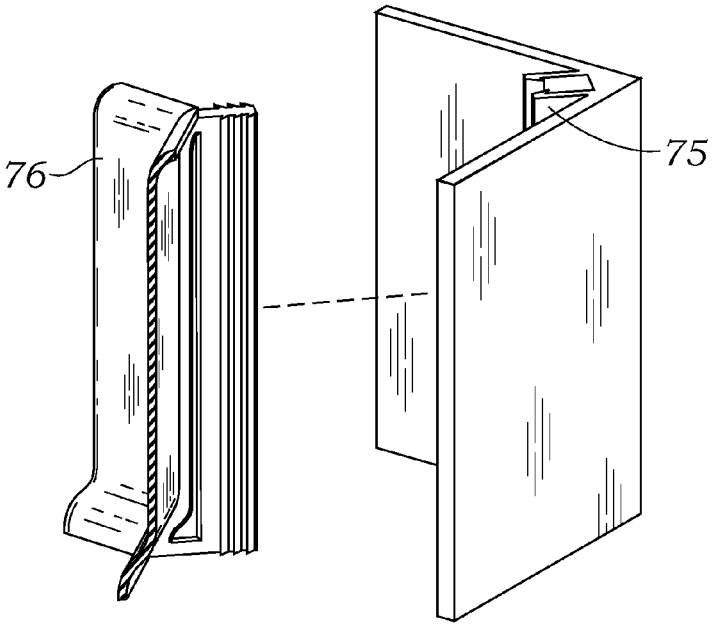
FIG. 11 is a cutaway side view of a version using a rod and cylinder-mating scheme.
Figure 12:
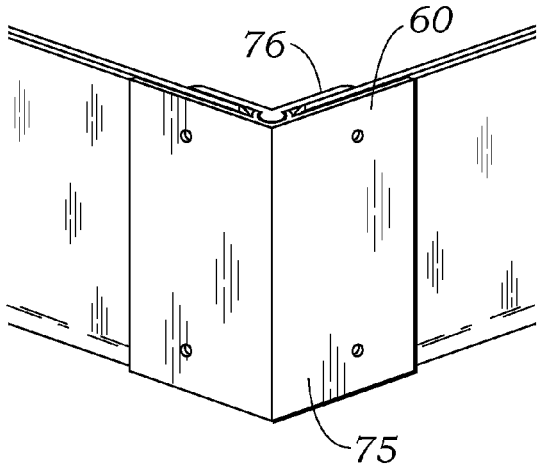
FIG. 12 is a rear view of an assembled system for covering an inside corner, the depicted version uses a rod and cylinder mating scheme.
Figure 13:
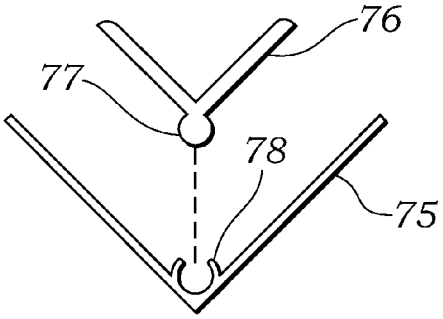
FIG. 13 is a plan schematic view of the mating of the apparatus of FIG. 12.

As will be understood by those skilled in the art a wide variety of complementary mechanical mating structures can be used to secure the described wall adapter to a corner cover—each with differing advantages and disadvantages. Three additional structures are shown and described herein. FIGS. 11, 12, and 13 show a version for an inside corner with a cover 75 and a wall adapter 76 that interconnect via a vertical rod 77 on the rear of the cover fitting in to a vertical hollow cut away cylinder 78 on the apex of the wall adapter. Alternatively, this design can be embodied as a snap-fit, a friction fit, a spring-like fit, or a loose fit. FIG. 11 is a side cut-away view of the mating. FIG. 12 shows an assembled system from the rear side. The wall adapter 75 cove base 60 and the top of the cover 76 are seen, in this view, for clarity of the structure the cover's upper portion is not shown curved back towards the wall. FIG. 13 is a plan schematic view showing the rod 77 and hollow cylinder 78 mating scheme.

Slot and Hanging Tab Version

Figure 14:
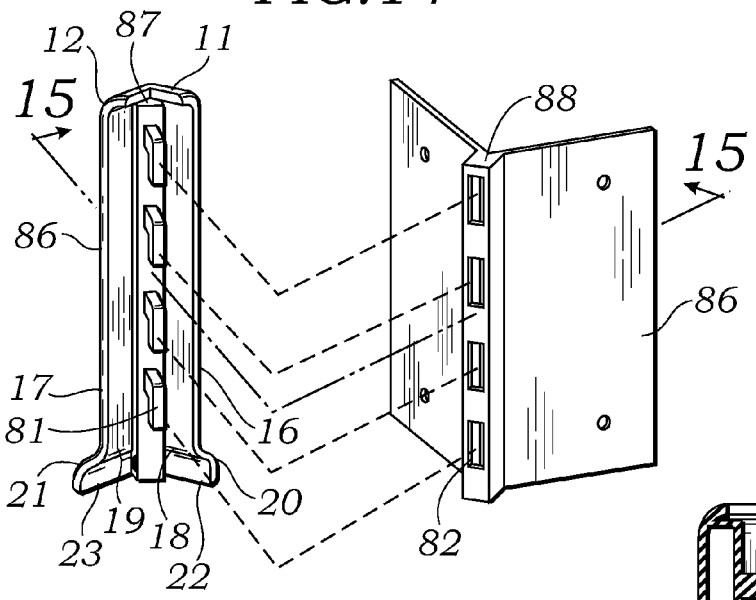
FIG. 14 is a perspective view of an alternate embodiment of an outside corner cover system, in this version the mating is via a hanging tab and slot.
Figure 15:
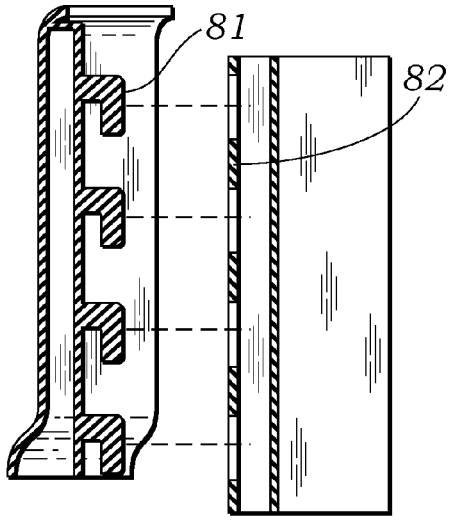
FIG. 15 is a cut away view of the apparatus of FIG. 14 taken along the line 15-15.
Figure 16:
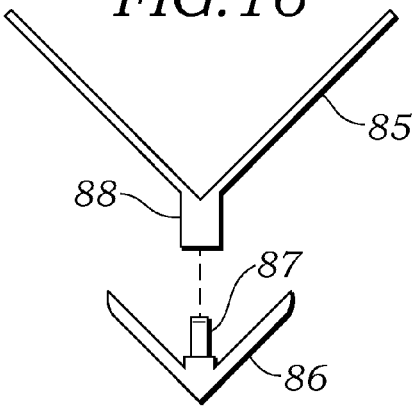
FIG. 16 is a plan schematic view of the mating of the apparatus of FIG. 14.

FIGS. 14, 15 and 16 depict various views of an outside corner cover system with a hanging tab and slot configuration. The cover 86 has a series of right angles, downward facing hooked tabs 82. The complementary structure on the convex apex of the wall adapter, are a series of slots 81. As shown, the parts fit together much like certain adjustable shelf brackets. FIG. 15 shows a cut-away view and FIG. 16 shows a plan, schematic view or the mating. This system will be appropriate in installations with clearance room to rise up the over at least by the height of a hook.

Slide and Snap Version

Figure 17:
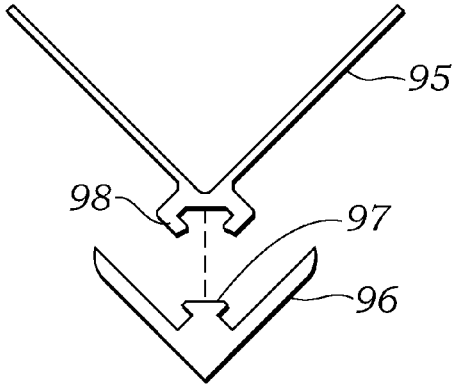
FIG. 17 is a plan schematic version of the mating of a slide and snap version of an outside corner cover.

A fourth interconnection version is seen in plan view in FIG. 17. It has similarities with the rod and cylinder version but could provide for a more secure connection. Rather than a circular cross section, the complementary mating shapes 97 98 of the cover 96 and wall adapter 95 respectively have a trapezoidal shape. This provides a greater total surface area in contact and several regions of jigsaw puzzle-like locking features. Like the rod version, this could be embodied in a snap or other fit designed for application by pressing the cover into the wall adapter in one straight motion. Alternatively, the fit between the two parts can be such as to provide for a slide fit. In that case, the cover 96 would be held above the wall adapter 95, aligned and then slid downward. By tapering, or other mechanical features, the cover could be securingly retained in an intended vertical position.

Transparent or Translucent Versions

Some users might prefer a cover of a color matching the color of the cove base. Clear corner covers can appear to take on the color of the cove base installed beneath them and therefore can be considered for universal use. Certain embodiments have a secure enough retention between a cover and wall adapter to require no additional bonding. The rear of the cover can be free of adhesive. Therefore, a translucent cover would not have any foreign material between it and the underlying cove base that contributed to its color.

Adhesive Set-Up Time Savings

If no inherent mechanical retention is provided in a corner cover apparatus, there is generally a requirement for an adhesive to be applied and care to be taken for a period of time to either physically hold the parts in position while the adhesive sets up or at least to protect the area from accidental disturbance during that period. Further, it may be prudent to recheck each corner after a period of time to confirm that all are secured in place correctly. A system that provides a positive retention obviates these needs by either dispensing with adhesive or providing a secure mechanical connection while an adhesive is setting.

It is claimed:

1. A cover for a corner formed by the intersection of two walls comprising two parts:

a) a cover comprising an upright member having two symmetrically disposed panels each of a substantially planar, elongated, thin, rectangular-solid shape and with substantially the same lengths; the panels mutually adjoined along respective first long edges to form a substantially 90-degree corner, whereby said upright member defines two sides, a generally convex side and an opposing generally concave side; further said upright member having an upper portion and a lower portion;

further, a foot depending from the lower portion of said upright member having a shape comprising two symmetric, generally planner regions each extending at an obtuse angle from a respective panel, the extending being in the direction of a first, nominally outer side of the two sides defined by said upright member;

still further, a top extending from the upper portion of said upright member having a shape comprising two symmetric regions each extending at an obtuse angle from a respective panel, the obtuse angle being toward the, nominally inner, side opposed to the direction of that of the foot; the extent of said top of a length whereby a corner cover held parallel to the intersection of the walls with its top abutted to the walls' corner defines an effective gap between the walls' respective surfaces and the corresponding parallel surfaces of the corner cover; and further, whereby in that orientation said top substantially hides an effective region behind the corner cover from view;

still further the shape and configuration of the inner side of the vertex of the 90-degree angle such as to form one-half of a complementary mechanical mating structure;

b) a wall adapter comprising a pair of thin planar panels mutually terminating and intersecting in a right angle and having a surface along the outer side of the vertex of the intersection of the panels so shaped and configured as to constitute mechanical mating structure complementary to that of the cover, for mutual mechanical coupling.

2. The apparatus of claim 1 wherein said foot's lower region comprises a downward lip having a terminus that substantially defines a plane perpendicular to both of the cover's panels' major planes.

3. The cover of claim 1 wherein the cover's foot, upright, and top are substantially integrally formed.

4. The cover of claim 3 wherein the defined gap is continuous with an upper aspect that is substantially linear leading to a generally arcuate lower aspect, whereby the shape of a cove base is accommodated and further wherein the first side of the corner cover is its generally concave side and wherein the cover is substantially comprised of a flexible material.

5. The apparatus of claim 1 wherein the first, nominally outer side of the corner cover is its generally concave side, whereby the apparatus is effective for covering an internal wall corner.

6. The apparatus of claim 1 wherein the first, nominally outer, side of the corner cover is its generally convex side, whereby the apparatus is effective for covering an outer wall corner.

7. The apparatus of claim 4 wherein the gap would be about one eighth of an inch.

8. The apparatus of claim 1 in which the thickness of the thin panels of the cover is between about 0.002 and 0.13 inches.

9. The apparatus of claim 1 wherein the complementary mechanical mating surfaces comprise a horizontal rod on one part and a hollow, cut away horizontal cylinder on the other part.

10. The apparatus of claim 1 wherein the complementary mechanical mating surfaces comprise complementary toothed structures providing two or more positions of mutual mechanical retention.

11. The corner cover of claim 1 wherein the orientation of the right angle connection is such as to provide for effective covering of an internal corner.

* * * * *